United States Patent [19]

Ljublinsky et al.

[11] 4,287,936

[45] Sep. 8, 1981

[54] INGOT CASTING APPARATUS

[76] Inventors: Efim Y. Ljublinsky, Vitebsky prospekt, 53, korpus 1, kv. 47, Leningrad; Viktor A. Smirnov, ulitsa Popova, 44, kv. 13; Anatoly A. Kostylev, ulitsa Bazstroevskaya, 8, kv. 26, both of Krasnoturiinsk Sverdlovskoi oblasti, all of U.S.S.R.

[21] Appl. No.: 961,249

[22] Filed: Nov. 16, 1978

[51] Int. Cl.[3] ..... B22D 5/04; B22D 9/00; B22D 29/04

[52] U.S. Cl. ..... 164/329; 164/130; 164/262; 164/264; 164/324

[58] Field of Search ..... 164/129, 130, 430, 329, 164/87, 322, 323, 271, 264, 88, 324, 262, 263

[56] References Cited

U.S. PATENT DOCUMENTS

| | | | |
|---|---|---|---|
| 866,607 | 9/1907 | Weimer | 164/130 |
| 1,354,975 | 10/1920 | Hurst | 164/329 |
| 3,281,903 | 11/1966 | Ross | 164/88 X |
| 3,506,061 | 4/1970 | Clemm | 164/264 X |
| 3,976,120 | 8/1976 | Raab | 164/130 X |

OTHER PUBLICATIONS

Rogozhin, K. F. "A Casting Apparatus with a Device to Open Molds", *Foundry Practice,* No. 11, 1963, p. 39.

Lizunov, E. A. "A Mold Casting Apparatus", *Foundry Practice,* No. 11, 1963, pp. 39–40.

*Primary Examiner*—R. L. Spruill
*Assistant Examiner*—Gus T. Hampilos
*Attorney, Agent, or Firm*—Lackenbach, Lilling & Siegel

[57] ABSTRACT

An ingot casting apparatus having an open top ingot moulds hinged to an endless hauling chain of a conveyer. The conveyer is inclined so that the upper descending branch of the endless chain with the ingot moulds placed thereon is inclined to the horizontal at an angle of 30°–60°. Each ingot mould is formed by a bottom, two longitudinal walls and a single transverse wall. The transverse wall of each ingot mould is provided with an opening for passage of the molten metal. With such an arrangement the cavities of the ingot moulds communicate with one another by means of openings provided in the transverse wall of each ingot mould. Mounted above the ingot moulds arranged on the upper descending branch of the endless chain of the conveyer, below the zone where the molten metal is poured into the ingot moulds, is a water-cooled plate adjoining tightly to the top ribs of the walls of the ingot moulds passing under the plate after the molten metal has been poured into them.

3 Claims, 7 Drawing Figures

INGOT CASTING APPARATUS

FIELD OF THE INVENTION

The present invention relates to metallurgy, and more specifically to ingot casting apparatus used for production of a wide variety of castings.

The present invention can be used to best advantage to produce shaped ingots upon whose size and shape strict requirements are imposed, particularly protectors used for anticorrosive protection of metallic buildings and constructions.

BACKGROUND OF THE INVENTION

There are known casting machines used for the production of shaped ingots. The shaped ingot casting apparatus most generally employed is that known as a conveyer-type apparatus, which has ingot moulds or chills arranged on the endless chain of a coveyer. According to the construction of the ingot moulds or chills, such conveyer-type appratus can be used either for hot top casting or no-hot top casting. In the hot top casting apparatus it is common practice to use a hot top mounted on the top of an ingot mould for the purpose of containing feed or head metal and maintaining it molten while the metal in the ingot mould is solidifying. The metal in the hot top is above and in contact with the metal in the ingot mould so that as the metal in the ingot mould shrinks, the feed metal is fed down into the ingot body and thus prevents the formation of shrinkage cavities in the body of the ingot.

Even though it is possible to produce ingots of a good quality when practicing apparatus having ingot moulds provided with hot tops for the production of shaped ingots, there are some disadvantages inherent in such apparatus. One of these disadvantages consists in a considerable waste of starting metal contained in the hot tops. To provide a sufficient pressure of the molten metal required to avoid the formation of shrinkage cavities in the ingot, the molten metal of the hot top used for feeding of the ingot during solidification process must be of a large mass. For instance, up to 50% of the starting protector alloy is wasted as head metal required for feeding and formation of a protector when producing protectors with an apparatus provided with ingot moulds having hot tops.

Another disadvantage of apparatus provided with ingot moulds having hot tops resides in complexity of such ingot moulds. Since these hot tops are intended to delay solidification of feed or head metal contained therein, the hot tops must be provided with a heat-insulating liner which also results in complexity of their construction.

In addition, it is necessary to use special complex devices to extract finished shaped ingots out of such ingot moulds and it is then necessary to cut off the head from the articles so produced, which increases labour consumption during production of such articles.

Also known in the art is an ingot casting apparatus provided with open ingot moulds. One such apparatus comprises open ingot moulds hinged to an endless hauling chain of an inclined conveyer. The hauling chain is passed through toothed drums, one of which serves as driving drum.

In such prior art apparatus the open ingot moulds moving along the conveyer are passed in sequence under a tundish from which the molten metal is poured into the ingot moulds. The length of the conveyer and the travel speed of the ingot moulds are chosen such as to ensure complete solidification of the molten metal poured into the ingot mould during the period when the ingot mould moves from the metal pouring point to a deflecting toothed drum where the change of the conveyer branch motion direction occurs. When the upper branch of the conveyer chain is turned around the deflecting toothed drum, the ingot mould is turned around the hinges and tipped. As this takes place, the ingot mould is struck against a stop, therby providing knock-out of the casting from the ingot mould.

Such apparatus is characterized by simplicity and it has some disadvantages. Since shrinkage cavities are formed during solidification in the case when metal is poured into open ingot moulds, it is necessary to cast articles provided with considerable thickness shrinkage allowances that must be subsequently mechanically worked off, which results in an increased labour consumption and a considerably decreased metal-saving ratio.

Besides, such apparatus fails to provide articles of a predetermined size due to metal shrinkage during solidification.

SUMMARY OF THE INVENTION

It is accordingly among the principal objects of the present invention to provide an ingot casting apparatus for avoiding the aforesaid drawbacks of the prior art.

It is another object of the present invention to provide an ingot casting apparatus enabling one to ensure a high quality of the ingots being cast, thereby providing articles ready for use without mechanical working.

It is a further object of the present invention to provide an ingot casting apparatus such as to ensure a continuous additional feeding of metal into the ingots during solidification, thereby preventing the formation of shrinkage cavities in a finished ingot, all with a simple technique, minus the complex hot tops.

It is still another object of the present invention to provide an ingot casting apparatus capable of cutting down waste of the starting metal.

It is yet another object of the present invention to provide an ingot casting apparatus with an increased output.

With these and other objects in view, there is provided an ingot casting apparatus comprising open top ingot moulds hinged to an endless hauling chain of an inclined conveyer, wherein, according to the invention, the cavities of the ingot moulds arranged on the upper descending branch of the endless hauling chain of the conveyer communicate by means of openings provided in the transverse walls of the ingot moulds and a cooled plate is arranged above the upper descending branch of the conveyer below the zone where the metal is poured into the ingot moulds, thereby closing the cavities of the ingot moulds passing under the plate.

With such an arrangement of the ingot moulds on the upper descending branch of the conveyer endless hauling chain when their cavities communicate by means of openings provided in the transverse walls of the ingot moulds, the feed metal is continuously fed down into the ingot mould where solidification takes place from the upper ingot mould, as the molten metal is poured into the ingot moulds.

At the same time, the cooled plate arranged below the metal pouring zone and closing the cavities of the open top ingot moulds promotes a quick formation of a solidified skin on the surface of the metal in the ingot mould passing under the plate, which combined with the continuous additional feeding of metal into the ingot from the upper ingot mould ensures the ingot being kept free from shrinkage during solidification, without any shrinkage cavities.

It is expedient to fashion the open ingot moulds arranged on the endless hauling chain of the conveyer as consisting of a bottom, two longitudinal walls and a single transverse wall having and opening, the bottom being provided with a boss located at the transverse rib thereof adjacent to the transverse wall, which boss has a horizontal seat adjoining the exterior side of the end wall and arranged at the same level with the lower surface of the bottom. Upon such seat the adjacent ingot mould located on the upper descending branch of the conveyer is rested, thereby providing a tight coupling of the ingot moulds located on the upper descending branch of the conveyer, whose cavities communicate by means of the openings.

Such an embodiment of the ingot moulds with a single transverse wall provided with an opening for passage of molten metal permits an easy communication of the cavities of the ingot moulds located on the upper descending branch of the conveyer endless chain. The horizontal seat provided on the bottom boss of the ingot moulds upon which the end portion of the ingot mould located further down the descending branch of the conveyer hauling chain is rested ensures precise alignment of adjacent ingot moulds.

It is practicable to arrange the upper descending branch of the endless hauling chain of the conveyer inclined to the horizontal at an angle chosen from the range of 30°–60°.

The inclination angle of the ingot moulds arranged on the upper descending branch of the conveyer chain must be chosen such as to ensure a sufficient additional feeding of the molten metal to a lower ingot mould on the descending branch of the conveyer, from an upper ingot mould as the ingot mould passes under the cooled plate. In the range indicated above, the choice of an optimum inclination angle depends on a variety of factors, namely mass and size of ingots being cast, ingot starting material, casting temperature, melt viscosity, the motion rate of the ingot moulds travelling along the conveyer, ingot mould temperature etc.

BRIEF DESCRIPTION OF THE DRAWINGS

The present invention will be apparent from the following detailed specification and the accompanying drawings, in which.

DETAILED DESCRIPTION OF THE PRESENT INVENTION

Figure 1:
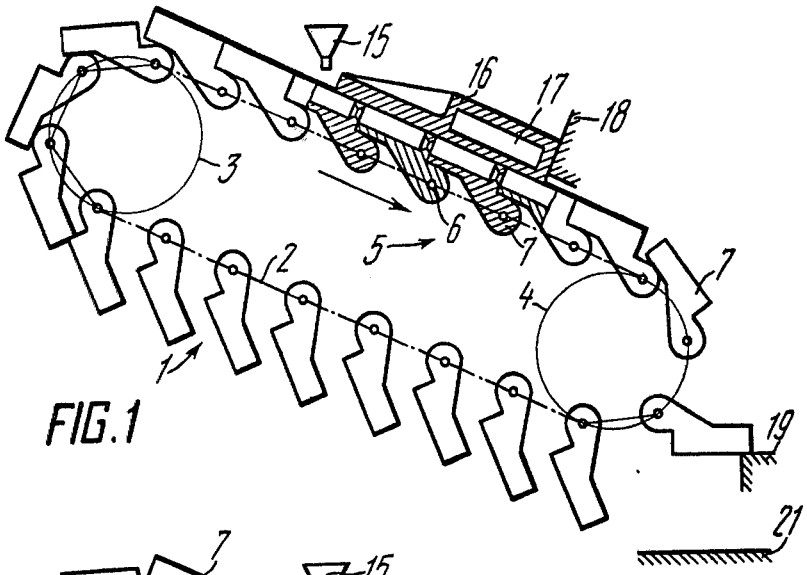
FIG. 1 is an ingot casting apparatus according to the invention, a schematical side view.

The ingot casting apparatus according to the present invention comprises a conveyer 1 (FIG. 1, 2) consisting of an endless hauling chain 2 passing over a driving sprocket 3 and a tension sprocket 4.

The driving sprocket 3 is coupled to a device (not shown) to effect its vertical movement so as to provide an inclination of an upper descending branch 5 of the conveyer varying in the range of 30°–60° to the horizontal. There is no need to describe nor illustrate here any device serving to vertically move the driving drum of the conveyer, since any device known to those skilled in the art can be used to this end.

The driving sprocket 3 is coupled to a drive means (not shown) to effect clockwise direction of movement of the conveyer.

Hinged to the endless chain 2 by means of hinges 6 are ingot moulds 7. While in the embodiment of the present invention illustrated herein there are shown twenty-five such ingot moulds mounted on the endless hauling chain 2 of the conveyer 1, it will be understood that a greater or smaller number of moulds can be used, as desired.

Figure 3:
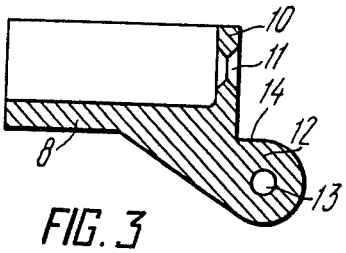
FIG. 3 is a longitudinal section of an ingot mould.
Figure 5:
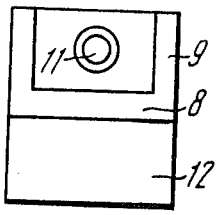
FIG. 5 is a front view of the same.
Figure 4:
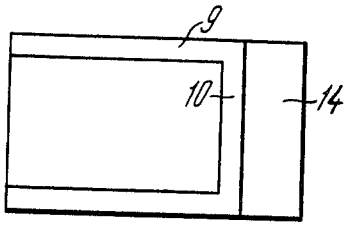
FIG. 4 is a top view of the same.
Figure 6:
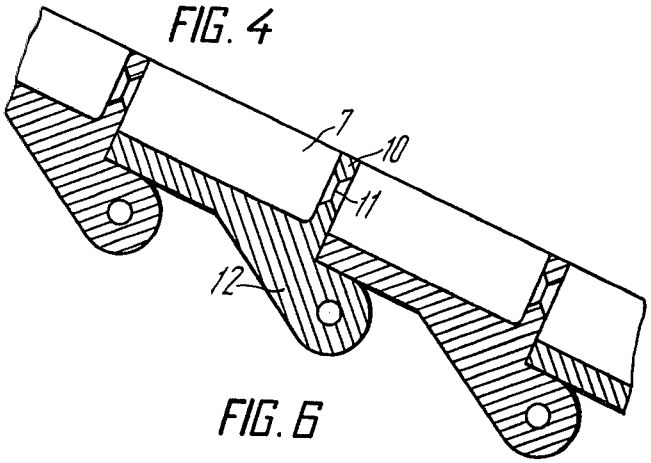
FIG. 6 is a longitudinal view of coupled ingot moulds arranged on the upper descending chain of a conveyer; and, FIG. 7 is a top view of the same.
Figure 7:
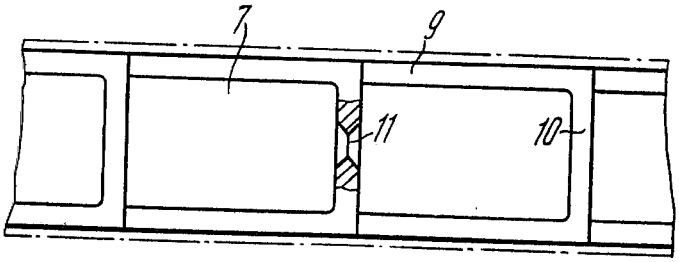

Each ingot mould 7 consists of a bottom 8 (FIGS. 3, 4, 5), two longitudinal walls 9 and one transverse wall 10 provided with an opening 11. Provided on the rib of the bottom 8 of each ingot mould 7, adjacent to the transverse wall 10, is a boss 12. Provided in the boss 12 is an opening 13 with the aid of which the ingot mould 7 is mounted on the endless chain 2 of the conveyer 1 by means of the hinge 6.

Provided on the boss 12 from the outside of the transverse wall 10 is a horizontal seat 14 arranged normal to the transverse wall 10 at the same level with the lower surface of the bottom 8.

Arranged at the top of the conveyer above the ingot moulds is a tundish 15 (FIGS. 1, 2) for pouring of the molten metal into the ingot moulds 7. Mounted in the immediate vicinity of the metal pouring zone is a water-cooled plate 16 adjoining the top ends of the ingot moulds 7.

A hollow 17, in the plate 16 serves for continuous water coolant supply.

The plate 16 is secured to a support 18. The length of the water-cooled plate 16 is adopted such as to ensure complete solidification of the metal in the ingot mould 7 when it appears from under the plate.

Placed close to the sprocket 4 is a stop 19 against which the ingot mould 7 is struck when traveling around the sprocket 4, thereby providing the knock-out of an ingot 20 that falls on a receiving table 21.

The ingot casting apparatus operates as follows.

According to characteristics of the ingot being produced as well as properties of the starting metal, an angle of inclination of the conveyer to the horizontal is set by adjusting the lift of the driving sprocket 3, and also a suitable motion rate of the ingot moulds 7 is adopted. Water coolant is supplied to the hollow 7 of the plate 16 and the conveyer 1 is started.

As mentioned above, it is an advantage of the present invention that the ingot moulds are fashioned so that when moving on the upper descending branch of the conveyer, their cavities are in communication with one another and at the same time a tight coupling of adjacent ingot moulds is ensured, thereby eliminating leakage of the molten metal.

Such a tight coupling is accomplished by using the upper sprocket 3 and also by having the horizontal seat 14 provided on the boss 12.

Figure 2:
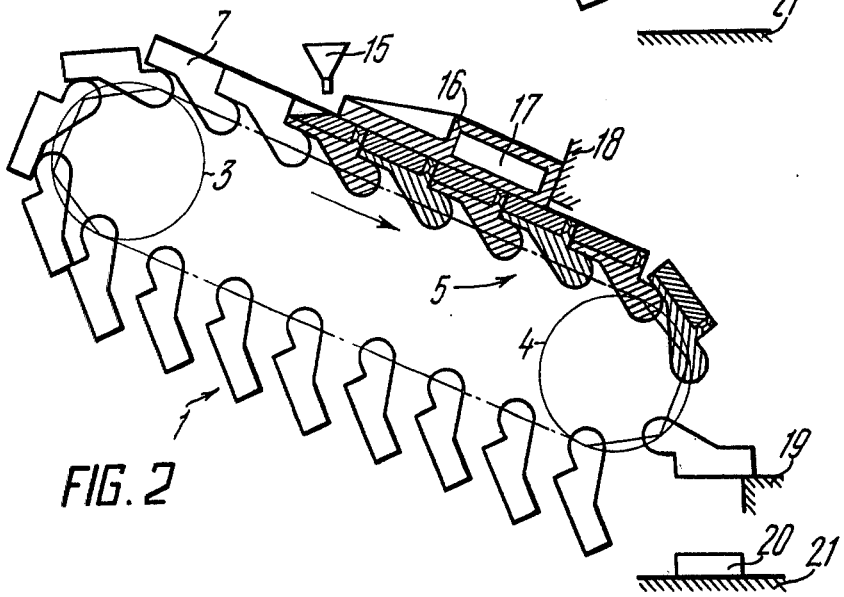
FIG. 2 is an ingot casting apparatus when metal is poured into the ingot moulds.

As illustrated in FIG. 2, in operation, the ingot moulds 7 moving off the driving sprocket 3 rotating in a clockwise direction, and proceeding to the descending branch 5 of the chain 2 are arranged so that the rear end of each lower ingot mould is rested upon the horizontal seat 14 of the next upper ingot mould. This enables precise alignment of the transverse ends of the ingot moulds. At the same time, since each upper ingot mould acts as if pushing the lower ingot mould when the driving sprocket 3 rotates, the ribs of the longitudinal walls 9 and the bottom 8 of the lower ingot mould are pressed against the transverse wall of the upper ingot mould, thereby providing tight coupling of the ingot moulds 7 arranged on the upper descending branch 5 of the conveyer 1.

A molten metal jet is supplied from the tundish 15 to an ingot mould as it approaches the cooled plate 16. The ingot mould cavity is still incompletely filled with metal when the ingot mould enters under the plate 16. At this instant the molten metal jet from the tundish 15 is supplied to the next approaching ingot mould from which the metal flows over to the lower ingot mould through the opening 11, thereby providing additional feeding of metal into the ingot solidifying therein.

As the ingot moulds filled with metal move under the plate 16, further solidification of the metal takes place and when the mould appears from under the plate 16 there is a completely solidified ingot.

As the ingot mould turns around the deflecting drum 4 a sprue (not shown) is broken at the opening 11 of the transverse wall 10 of the ingot mould 7.

The ingot mould is then tipped when turning around the hinge 6, struck against the stop 19 and the ingot 20 falls to the receiving table 21.

As can be seen from the foregoing detailed description, the present invention provides an improved ingot casting apparatus which permits using a simple technique to cast shaped castings of a high quality requiring no mechanical working, thereby ensuring a high efficiency of such an apparatus and a considerable decrease in the starting metal waste.

In the description of the embodiment of the present invention disclosed above, specific narrow terminology has been resorted to for the sake of clarity. It should be understood, however, that the present invention is no way limited to the terms so selected and that each such term covers all equivalent elements operating in a similar manner and employed for solving similar problems.

Though the present invention has been described herein with reference to a preferred exemplary embodiment thereof, it will be understood that minor changes in the details of construction may be made without departing from the spirit and scope of the invention, as will be readily understood by those skilled in the art.

All these alterations and changes will be considered to remain within the limits of the spirit and scope of the invention.

Thus, for instance, conventional ingot moulds provided with four walls may also be used in the apparatus. However, in such a case it would be necessary to provide openings in each transverse wall of the ingot mould and a sealed means would be required to communicate the openings in the transverse walls of each two ingot moulds which, as understood, results in a complex construction.

We claim:

1. In an ingot casting apparatus comprising open top ingot moulds hinged to an endless revolving hauling chain of an inclined conveyer and means for feeding molten metal into open tops of said ingot moulds, wherein the improvement comprises: ingot moulds arranged on an upper descending branch of said endless hauling chain of said inclined conveyer and movable in descending direction along said upper descending branch, each ingot mould consisting of a bottom having an upper moulding surface and an opposed lower external surface, two longitudinal sidewalls associated with said bottom and extending parallel to the direction of descent of said ingot moulds along the upper descending branch and a single transverse wall adjoining said sidewalls and bottom, said single transverse wall extending normal to the direction of movement of said ingot moulds along said upper descending branch and each transverse wall being shaped to define at least one opening within said transverse wall and extending through said transverse wall, said single transverse wall including an internal moulding surface cooperating with said adjoining side walls and the upper moulding surface of said bottom to define a portion of said open top ingot mould cavity, and an external surface adapted to cooperate with an adjacent ingot mould along said upper descending branch to define an open top ingot mound cavity: said ingot moulds being arranged along said upper descending branch to provide a series of open top ingot moulds and cooperating to define a series of ingot mould cavities which are in communication with one another by said openings within the transverse walls of adjacent ingot moulds; means for feeding metal to said open top ingot moulds being arranged along said upper descending branch and a cooled plate disposed above said series of open top ingot moulds and downwardly along the upper descending branch relative to said means for feeding metal to sequentially close the ingot moulds as they pass beneath the cooled plate.

2. An ingot casting apparatus accoding to claim 1, wherein the bottom of said ingot mould is provided with a base adjoining the external surface of said transverse wall to define a seat having an upper surface normal to the external surface of said transverse wall and coplanar with the lower external surface of the bottom of said ingot mould, said ingot moulds being arranged along the upper descending branch to provide cooperation between the bottom of an ingot mold located downwardly along the upper descending branch relative to an adjacent ingot mould through controlled coincidence between the bottom of said downwardly located ingot mould and the seat of the adjacent ingot mould.

3. An ingot casting apparatus as in claim 2, wherein the upper descending branch of the endless hauling chain of the conveyer is inclined to the horizontal at an angle from 30 to 60 degrees.

* * * * *